US005230506A

United States Patent [19]

Cipriano et al.

[11] Patent Number: 5,230,506

[45] Date of Patent: Jul. 27, 1993

[54] BATTING PRACTICE DEVICE

[76] Inventors: Ronald J. Cipriano; Kathleen L. Cipriano, both of 120 Sunset Dr., Longwood, Fla. 32750

[21] Appl. No.: 844,557

[22] Filed: Mar. 2, 1992

[51] Int. Cl.[5] ..... A63B 69/40

[52] U.S. Cl. ..... 273/26 R

[58] Field of Search ..... 273/26 B, 26 R, 29 A, 273/72 A, DIG. 8, 72 R, 67 R, 84 R, 193 R, 77 A, 80 R, 80 B, 80 C, 80 D, 80.4, 80.8, 81.2

[56] References Cited

U.S. PATENT DOCUMENTS

| | | | |
|---|---|---|---|
| 1,118,033 | 10/1978 | Miyamoto | 273/80 B |
| 2,765,170 | 10/1956 | Brown | 273/26 E |
| 3,341,202 | 9/1967 | Stars | 273/80 X |
| 3,428,325 | 2/1969 | Atkinson | 273/26 B |
| 3,743,297 | 7/1973 | Dennis | 273/175 |
| 3,921,976 | 11/1975 | Lane | 273/26 |
| 4,022,467 | 5/1977 | Reuss | 273/29 A |
| 4,513,965 | 4/1985 | Aschermann | 273/26 |
| 4,555,111 | 11/1985 | Alverez | 273/26 B |
| 4,682,773 | 7/1987 | Pamilla | 273/26 B |
| 4,785,495 | 11/1988 | Dellis | 273/81 X |
| 4,830,371 | 5/1989 | Lay | 273/26 |
| 4,846,472 | 7/1989 | Terza | 273/26 |
| 5,014,984 | 5/1991 | Brackhoff | 273/26 B |

FOREIGN PATENT DOCUMENTS

| | | | |
|---|---|---|---|
| 854911 | 8/1949 | Fed. Rep. of Germany | 273/80 B |
| 341749 | 1/1931 | United Kingdom | 273/80.8 |
| 477320 | 5/1936 | United Kingdom | 273/80.8 |

*Primary Examiner*—Theatrice Brown

*Attorney, Agent, or Firm*—Michael K. Gray

[57] ABSTRACT

A sport training device having a hollow shaft into which is connected a flexible hollow rod which is secured to the shaft in such a manner that a region of the flexible hollow rod located inside of the shaft is separated by a air space from an interior wall of the shaft. A ball-shaped target is connected to the flexible hollow rod at the target end of the device. A rubber or rubber-like handle is attached to the shaft at the holding end of the training device.

7 Claims, 1 Drawing Sheet

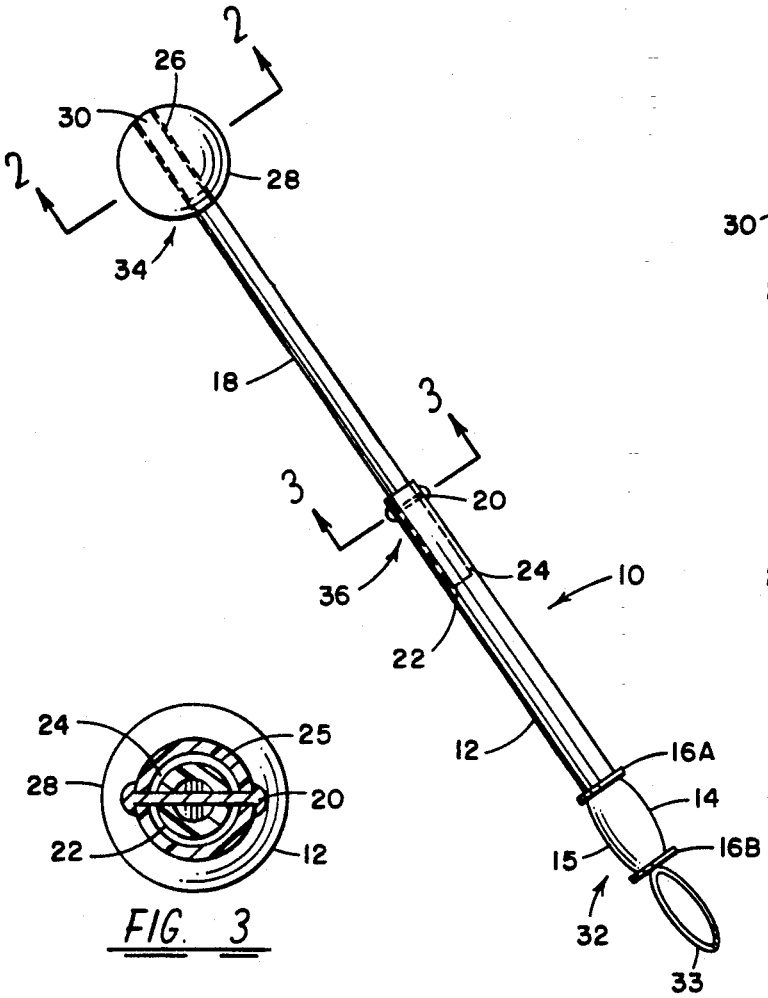
FIG. 1
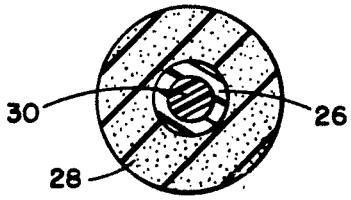
FIG. 2A
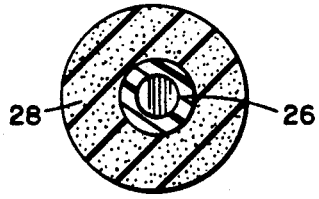
FIG. 2B
FIG. 3
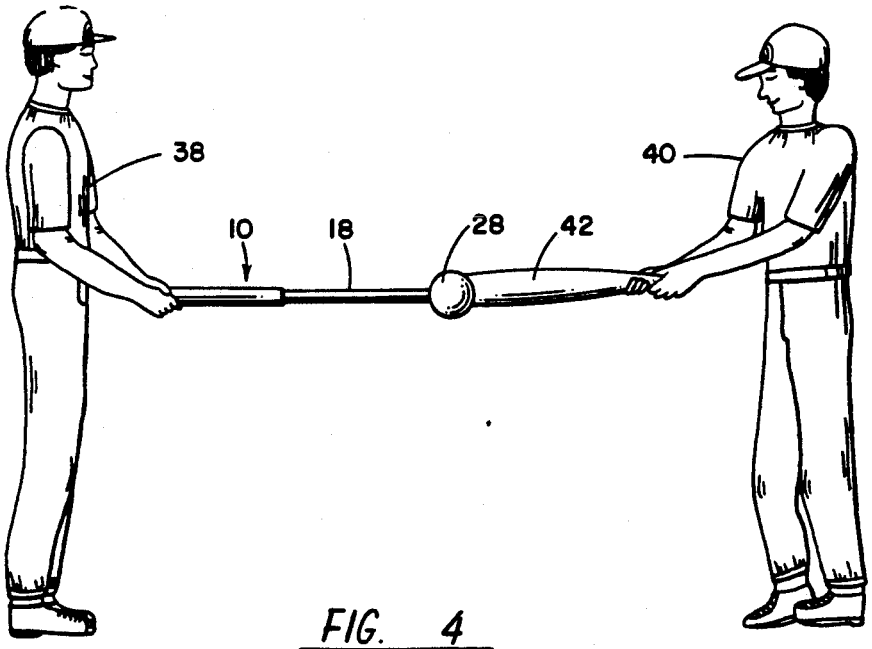
FIG. 4

BATTING PRACTICE DEVICE

BACKGROUND OF THE INVENTION

1. Field of the Invention

The present invention relates to sporting equipment and more particularly to an improved batting practice device.

2. Discussion of the Background

The prior art exhibits a number of training devices for improved batting performance. One example is that of batting-tee-type devices. The batting-tee devices exhibit a vertical support member upon which a ball is placed. A batter can then swing at the stationary ball on top of the support member thereby removing the need for a pitcher. Some designs have exhibited an elastic support member which is integral with a ball-shaped region at the top of the support member. One such device which teaches an integral support and ball-shaped region is disclosed in U.S. Pat. No. 4,846,472. Such an integral batting tee device removes the need for retrieving batted balls. However, one problem with batting tees is that they do not lend themselves to the practice of hitting a moving object. Furthermore, in that it is desirable to gain proficiency in hitting balls at various locations of the strike zone, time is wasted in adjusting the batting tee to a desired height and position.

An answer to the problems inherent in stationary batting tees has been addressed by the introduction of hand-held batting practice devices. These devices are typically characterized by exhibiting a gripping portion, a connecting portion, and an impact portion. In operation, the hand-held batting practice devices require a holder and a batter. One individual holds the gripping portion of the device and extends the device so that the impact portion of the device is in a desired location for the batter to practice his or her swing. By the holder moving and accelerating the device, a batter can practice hitting different types of pitches at various locations of the strike zone.

One hand-held batting practice device is disclosed in U.S. Pat. No. 2,765,170. The device has a helical spring which is connected to a gripping region located at one end of the helical spring, the other end of the helical spring being connected to a ball. However, one drawback of the device taught in U.S. Pat. No. 2,765,170 is that the device is held such that it descends, as opposed to extending laterally, from the holder's hands. In that the device disclosed in U.S. Pat. No. 2,765,170 descends from the holder's hand, the holder is placed in closer proximity to the batter which increases the probability of a holder being accidently struck by a bat.

Other hand-held batting practice devices are disclosed in U.S. Pat. Nos. 3,921,976, 4,513,965, and 4,846,472. These devices are intended to be held such that the ball or impact regions of the devices extend laterally away from the holder and toward the batter. However, one problem with these devices is that the holder's hand, elbow and shoulder can be subjected to significant stress and strain as a result of impact-produced torque.

U.S. Pat. No. 4,846,472 does seek to reduce the impact-produced shock experienced by a holder's hands. However, the device taught in U.S. Pat. No. 4,846,472 teaches a singular tubular extension which is connected at one end to a grip region. At the end opposite to the grip region is located an opening to the tubular extension and it is upon this opening that a ball is positioned in a rest position. The ball is secured to the device by means of an elastic chord or string. A screw connects the one end of the string to the grip at a location inside of the tubular extension. A second screw connects the other end of the string to the ball. In that a bat will most often impact both the ball and that part of the tubular extension proximate the ball, significant torque will still be experienced at the grip region. Furthermore, string and screw connections have a history and propensity of becoming disengaged when exposed to significant stresses over time.

Thus, a need exists for a simple, easily used and durable hand-held batting practice device which will tend to minimize the reaction forces imparted to the holder of the device.

SUMMARY OF THE INVENTION

Accordingly, one object of the present invention is to provide a light-weight batting practice device for the teaching and improving of hand-eye coordination.

Yet another object of the present invention is to provide a hand-held batting practice device which minimizes the occurrence of injury to the holder.

Still another object of the present invention is to provide a batting practice device which is economical and of simple construction.

These and other valuable objects and advantages, according to the present invention, are provided in a sport training device for ball-striking sports such as baseball and tennis. The sport training device of the present invention has a shaft, a flexible member connected to the shaft and a target connected to the flexible member at a target end of the training device. The target is spherical in shape to resemble a ball and is preferably made of foam rubber or similar material which will absorb the shock of impact. The shaft of the present invention is tubular and hollow, and a handle is connected to the shaft at the holding end of the device. The handle has a gripping portion integrally connected and positioned between a front and a rear flange.

The flexible member has a diameter less than the diameter of the shaft to allow insertion of a region of the flexible member inside the shaft. The center of the target is hollow to allow a target region of the flexible member to be inserted into the center of the target and secured thereto. A cavity in the target region of the flexible member is filled with a plug for purposes of reinforcing the target region of the flexible member. Alternatively, the target region of the flexible member is molded to the target which removes the need for a plug.

The sport training device of the present invention is provided with a connecting means for connecting the shaft to the flexible member such that an air space exists between the region of the flexible member located inside of the shaft and an interior wall of the shaft. The shaft, flexible member, and the connecting means comprise a torque reduction means for reducing the torque experienced by an individual holding the handle when the target is struck by a striking member swung by a second individual. The handle is a shock absorbing means in that it is made of rubber or other appropriate material to absorb shock and vibrations.

BRIEF DESCRIPTION OF THE DRAWINGS

A more complete appreciation of the invention and many of the attendant advantages thereof will be readily obtained as the same becomes better understood by reference to the following detailed description when considered in connection with the accompanying drawings, wherein:

FIG. 1 is a schematic illustration of the present invention;

FIG. 2A is a cross-sectional illustration taken along line 2—2 of FIG. 1 which demonstrates the target region of the flexible member, the target and plug according to one embodiment of the present invention;

FIG. 2B is a cross-sectional illustration taken along line 2—2 of FIG. 1 and demonstrates the molded interface of the target region of the flexible member and the target according to another embodiment of the present invention;

FIG. 3 is a cross-sectional illustration taken along line 3—3 of FIG. 1; and

FIG. 4 is an exemplary illustration demonstrating the present invention in a user setting.

When referring to the drawings, it should be understood that like reference numerals designate identical or corresponding parts throughout the respective figures.

THE DETAILED DESCRIPTION OF THE INVENTION

With reference to FIG.1, the batting practice device 10 according to the present invention has a shaft 12 which is connected to a handle 14 at the holding end 32 of device 10. Shaft 12 is tubular and is preferably made of P.V.C. pipe or a suitable substitute material. In the prototype of the present invention, shaft 12 was twenty-seven inches long.

Handle 14 (FIG. 1) is comprised of a gripping portion 15 which is integrally connected to a front flange 16A and a rear flange 16B. Handle 14 is preferably made of one-piece, molded foam rubber or other easily grippable and shock absorbing material. The handle 14 is inserted over the holding end 32 of the shaft 12 and glued thereto in much the same manner that grips are attached to a bicycle handle. In the prototype of the present invention the handle 14 was approximately four and ¾ inches long. A chord 33 is attached to the handle 14.

A flexible member 18 is connected to shaft 12. Flexible member 18 has a diameter which is less than the diameter of the hollow region of shaft 12. Flexible member 18 is preferably made of flexible plastic tubing or a material having similar physical properties. Alternatively, flexible member 18 could be a solid-flexible rod. In the prototype of the present invention, the flexible member 18 had a total length of twenty-two inches and had a diameter of ⅝ inches.

A region 22 of flexible member 18 is inserted inside of shaft 12 at the connecting end 36 of shaft 12. In the prototype of the present invention, the region 22 which was inserted inside of shaft 12 was approximately three inches long. A connecting means 20 (rivet) extends through holes in the shaft 12 and region 22 of flexible member 18 and secures flexible member 18 to the shaft 12. Flexible member 18 has a target region 26 which is connected to a hollow center region of target 28 at the target end 34 of device 10. Target 28 is spherical in shape so as to resemble a ball and is preferably made of foam rubber or similar material. In the prototype of the present invention the target 28 approximated the shape and size of a baseball, although the target 28 can be manufactured in any number of sizes. A solid plug 30 (FIG. 2A) preferably made of a durable lightweight plastic is inserted into the tubular cavity of region 26 to reinforce and strengthen region 26.

FIG. 2A is a cross-sectional illustration taken along line 2—2 of FIG. 1, and demonstrates that plastic plug 30 represents a core of the target end 34 of device 10. Plug 30 represents a solid area inside of region 26 with region 26 being interfaced with and secured to target 28. Preferably target region 26 is epoxied to target 28 or secured in such a manner so as to form a strong bond between the region 26 of flexible member 18 and the target 28.

FIG. 2B is an alternative embodiment of the present invention in which the target 28 and the target region 26 of flexible member 18 are molded together. The molded connection of the target region 26 and target 28 enhances durability and removes the need for the plug 30 shown in FIG. 2A.

FIG. 3 is a cross-sectional illustration taken along line 3—3 of FIG. 1, and demonstrates that connecting means 20 connects region 22 (of flexible member 18) and shaft 12 in such a manner that an airspace 24 exists between region 22 and an interior wall 25 of shaft 12.

The connecting means 20 (rivet), shaft 12 and flexible member 18 represent a torque reducing means in that most of the load resulting from the target 28 being impacted is translated to the connecting means 20 and not to the handle 14 at the holding end of the device. Further, the target 28 is made of foam rubber or other shock absorbing material to reduce the initial shock experienced by the device 10. Also, the handle 14 is made of a shock absorbing material (e.g. rubber) to reduce the amount of vibration experienced by an individual holding the device 10 when the target 28 is impacted by a striking object.

In FIG. 4, two individuals are represented. One individual is a holder 38 who is holding the device 10 while the second individual, batter 40, swings a bat 42 to impact upon target 28. The holder can move and swing the device 10 in such a manner that batter 40 can effectively practice hitting various types of pitches at various speeds and locations in the strike zone. The cord 33 (see FIG. 1) can be used to secure the wrist of the holder 38 to the device 10. The chord 33 can also be used as a means to hang the device 10 up on a rack or hanger when the device 10 is not in use or in storage.

The batting practice device 10 of the present invention effectively reduces the torque experienced by a first person holding the device (e.g., holder 38 of FIG. 4) when the target 28 is impacted by the bat of a second person, (e.g., batter 44). Connecting means 20 (FIG. 1) represents a connection point which connects flexible member 18 to shaft 12. Connecting means 20 is located approximately half-way between the target end 34 and the holding end 32 of device 10. When the target 28 of the device 10 is struck by batter 44 (FIG. 4), a bending moment will be exerted at the location of the connecting means 20. Since torque is equal to the cross product of Force and Distance (Torque$=F\times D$), the torque experienced by the holder 38 is substantially reduced by connecting flexible member 18 to shaft 12 by means of connecting means 20 at a location approximately half-way between the target end 34 and the holding end 32 of the device 10.

The device 10 of the present invention eliminates the need to chase balls and pitch balls and increases the amount of time to practice and concentrate on improving batting technique. The device is ideal for younger players such as little leaguers in that a player can be instantly corrected as to how to better hit a pitch and thereby improve, stance, swing, and hand/eye coordination. Further, the device has been designed to provide a maximum amount of safety to the holder of the device and is designed to minimize the amount of shock and torque experienced by a holder when the target 28 of the device 10 is impacted by a bat or other striking object.

The foregoing detailed description is intended to be illustrative and non-limiting. Many changes and modifications are possible in light of the above teachings. Thus, it is understood that the invention may be practiced otherwise than as specifically described herein and still be within the scope of the appended claims.

What is claimed is:

1. A sport practice device for developing ball-hitting skills, said device having a target end and a holding end, said device to be held by a first individual at said holding end such that said target end is pointed toward a second individual having a striking instrument for making contact with a target connected to said target end, said device having means for reducing the torque experienced by the first individual when said target is impacted by a striking instrument held by a second individual, said device comprising:

a substantially rigid portion tubular shaft, which includes said holding end of said device, said tubular shaft further including a connecting end opposite to said holding end;

a flexible tubular shaft member having a diameter less than that of said tubular shaft, said flexible member having one of its ends inserted into said tubular shaft at said connecting end the other end of said flexible member being said target end;

connecting means connecting said tubular shaft portion of said flexible member at a location approximately half-way between said target end and said holding end such that when the second individual strikes said target end with a striking instrument, while said device is held by the first individual at said holding end a bending moment is translated to said location approximately half-way between said target end and said holding end; and wherein said striking instrument is a bat.

2. A device according to claim 1, wherein said flexible member is tubular.

3. A device according to claim 1, wherein said connecting means is a rivet.

4. A device according to claim 1, wherein said target is a foam-rubber ball molded to said target end of said flexible member.

5. A device according to claim 1, wherein said flexible member has a length which is greater than 40% of a total length of said device.

6. A sport practice device for developing ball-hitting skills, said device having a target end and a holding end, said device to be held by a first individual at said holding end such that said target end is pointed toward a second individual having a striking instrument for making contact with a target connected to said target end, said device being for reducing the torque experienced by a first individual when said target is impacted by a striking instrument held by a second individual, said device comprising:

a substantially rigid tubular shaft which includes said holding end, said tubular shaft further including a connecting end opposite to said holding end;

an elongated tubular flexible member having a diameter less than that of said tubular shaft, said flexible member having one of its ends inserted into said tubular shaft at said connecting end, the other end said flexible member being said target end of said device; and connecting means connecting said tubular shaft and said flexible member at a location approximately half-way between said target end and said holding end of said device such that when swing by a second individual strikes said target end with the striking instrument, while said device is held by the first individual at said holding end, a bending moment is translated to said location approximately half-way between said target end and said holding end; and wherein said target end has a foam-rubber ball molded to said target end of said flexible member to define said target.

7. A device according to claim 6, wherein striking instrument is a bat.

* * * * *